US006393641B1

(12) United States Patent
Hensley

(10) Patent No.: US 6,393,641 B1
(45) Date of Patent: May 28, 2002

(54) ARTICULATING BED FRAME

(75) Inventor: David W. Hensley, Milan, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 09/461,623

(22) Filed: Dec. 15, 1999

Related U.S. Application Data

(63) Continuation-in-part of application No. 09/064,292, filed on Apr. 22, 1998, now Pat. No. 6,006,379.

(60) Provisional application No. 60/112,961, filed on Dec. 18, 1998.

(51) Int. Cl.[7] ..... A47B 7/02

(52) U.S. Cl. ..... 5/618; 5/613; 5/616; 5/617

(58) Field of Search ..... 5/613, 616, 617, 5/618

(56) References Cited

U.S. PATENT DOCUMENTS

| | | | |
|---|---|---|---|
| 3,565,501 | A | 2/1971 | Bowene et al. |
| 3,593,350 | A | 7/1971 | Knight et al. |
| 3,821,821 | A | 7/1974 | Burst et al. |
| 3,898,702 | A | 8/1975 | Goodman |
| 4,271,830 | A | 6/1981 | Moon |
| 4,361,917 | A | 12/1982 | Wilson |
| 4,381,571 | A | 5/1983 | Elliott |
| 4,385,410 | A | 5/1983 | Elliott et al. |
| 4,407,030 | A | 10/1983 | Elliot |
| 4,435,862 | A | 3/1984 | King et al. |
| 5,257,428 | A | 11/1993 | Mitchell |
| 5,494,333 | A | 2/1996 | Wilson |
| 5,502,849 | A | 4/1996 | Mitchell |
| 5,537,701 | A | 7/1996 | Elliott |
| 5,577,279 | A | 11/1996 | Foster et al. |
| 5,577,280 | A | 11/1996 | Elliott |
| 5,579,550 | A | 12/1996 | Bathrick et al. |
| 5,600,214 | A | 2/1997 | Fromson |
| 5,608,932 | A | 3/1997 | Hasegawa |
| 5,640,730 | A | 6/1997 | Godette |
| 5,680,661 | A | 10/1997 | Foster et al. |
| 5,682,629 | A | 11/1997 | Bortoluzzi |
| 5,740,568 | A | 4/1998 | Elliott |
| 5,870,784 | A | 2/1999 | Elliott |

FOREIGN PATENT DOCUMENTS

| | | |
|---|---|---|
| GB | 1230059 | 4/1971 |

*Primary Examiner*—Jack Lavinder
*Assistant Examiner*—James M. Hewitt
(74) *Attorney, Agent, or Firm*—Barnes & Thornburg

(57) ABSTRACT

An articulating mechanism includes a drive pivotally connected at a first end to the upper body section about a first pivot axis substantially perpendicular to the longitudinal axis of the bed and pivotally connected at a second end to the base frame about a second pivot axis parallel to the first pivot axis for translating the upper body section relative to the base frame, and a link pivotally connected at a first end to the upper body section about the first pivot axis and pivotally connected at a second end to the base frame about a third pivot axis parallel to the first pivot axis such that translation of the upper body section relative to the base frame results in tilting of the upper body section.

16 Claims, 6 Drawing Sheets

ARTICULATING BED FRAME

This application is a continuation-in-part of U.S. patent application, Ser. No. 09/064,292, filed on Apr. 22, 1998, entitled "Articulating Bed Frame", now U.S. Pat. No. 6,006, 379, and assigned to the same assignee as the present application, and claims the benefit of U.S. provisional patent application, Ser. No. 60/112,961, filed on Dec. 18, 1998.

BACKGROUND AND SUMMARY OF THE INVENTION

The present invention relates to articulating bed frames and more particularly to the provision of articulating bed frames which will move rectilinearly toward the wall or the stationary headboard when the upper body section of the bed is tilted upwardly toward an upward raised position, move rectilinearly toward the foot of the bed when the upper body section is tilted downwardly toward a generally horizontal rest position, and which can also be moved into a purchaser's home by one delivery person and assembled by that delivery person.

An articulating bed of this type is described in the afore-mentioned commonly-assigned U.S. patent application, Ser. No. 09/064,292, now U.S. Pat. No. 6,006, 379, the disclosure of which is incorporated herein by reference. The said articulating bed comprises a base frame having a head end, a foot end and opposite longitudinally extending sides. A carriage is mounted on the base frame for translation relative to the base frame along a longitudinal axis of the bed. An articulating upper frame is mounted to the carriage to provide articulating movement of upper body, thigh and leg sections of the upper frame. A seat section of the upper frame 44 is rigidly mounted to the carriage, so that when the carriage is translated the entire upper frame moves with it. As the upper frame moves toward the head end of the bed, a pair of links pivotally connected between the upper body section and the base frame cause the upper body section to tilt upwardly toward an upward raised position. As the upper frame moves toward the foot end of the bed, the links cause the upper body section to tilt downwardly toward a generally horizontal rest position.

The present invention relates to modifications of the articulating mechanism described in the foregoing patent application. The articulating mechanism of the present invention reduces forces experienced by the links connected between upper body section and the base frame, and the joints connecting the links to the upper body section and the base frame during lifting and lowering of the upper body section.

An articulating mechanism according to one embodiment of the present invention includes a drive pivotally connected at a first end to the upper body section about a first pivot axis substantially perpendicular to the longitudinal axis of the bed and pivotally connected at a second end to the base frame about a second pivot axis parallel to the first pivot axis for translating the upper body section relative to the base frame, and a link pivotally connected at a first end to the upper body section about the first pivot axis and pivotally connected at a second end to the base frame about a third pivot axis parallel to the first pivot axis such that translation of the upper body section relative to the base frame results in tilting of the upper body section.

According to another embodiment of the present invention, the articulating mechanism includes a drive operatively coupled between the carriage and the base frame to shift the carriage relative to the base frame, and a link having a first end pivotally coupled to the upper body section and a second end pivotally coupled to the base frame at a point above the base frame such that translation of the carriage relative to the base frame results in tilting of the upper body section.

Additional features, and advantages of the present invention will become apparent to those skilled in the art upon a consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
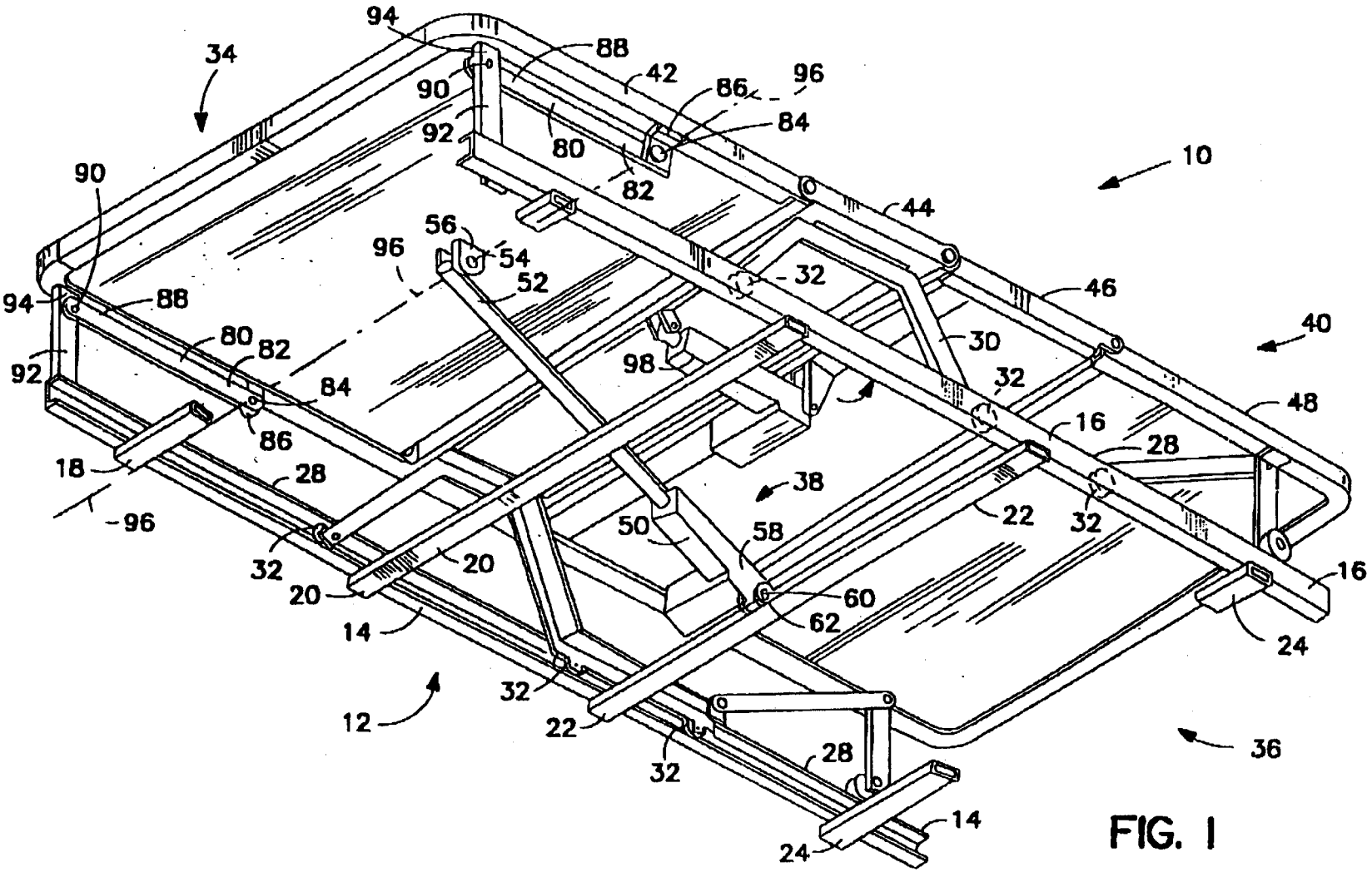
FIG. 1 is a bottom, left and front perspective view of the articulating bed incorporating the articulating mechanism of the present invention, showing a base, frame configured to be mounted on a conventional bed frame (not shown), a carriage configured to be mounted on the base frame for rectilinear motion along a longitudinal axis and an articulating upper frame configured to be mounted on the carriage for translation therewith, and showing drive assemblies for articulating upper body, thigh and leg sections of the upper frame.
Figure 2:
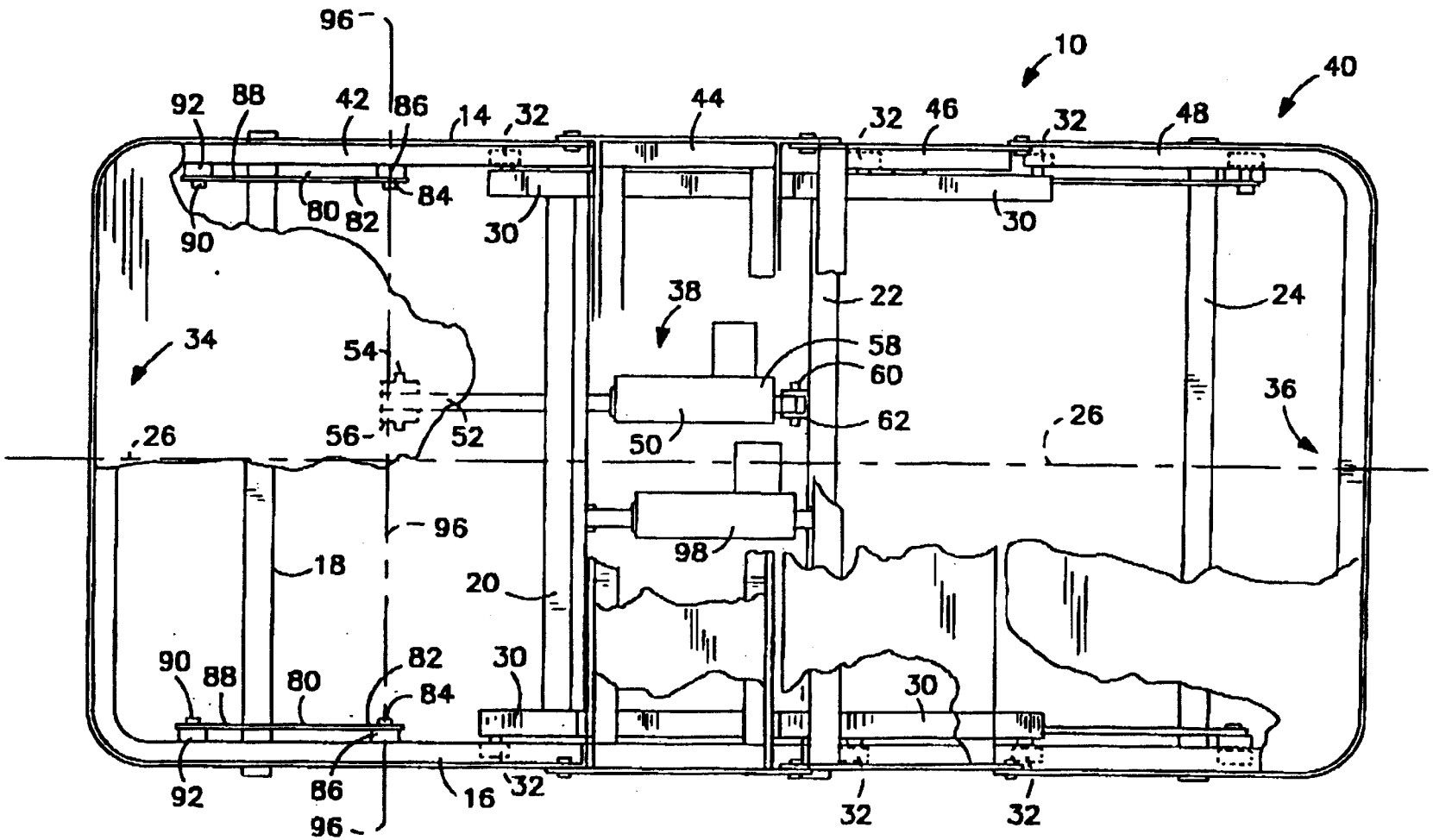
FIG. 2 shows a top view of the FIG. 1 bed, showing the carriage supported on the base frame, upper frame mounted on the carriage and drive assemblies for articulating the upper body, thigh and leg sections.

Referring to the drawings, an articulating bed 10 comprises a base frame 12 including a pair of inwardly facing, longitudinally extending siderails 14, 16 which are held in laterally spaced apart relation by four longitudinally spaced apart, transversely extending strut members 18, 20, 22, 24. The base frame 12 is designed to be picked up, transported and set up by a single delivery person. The base frame 12 is configured to be set atop a conventional bed frame (not shown). A carriage 30 having rollers 32 is mounted on the base frame 12 for rectilinear movement along a longitudinal axis 26 of the bed shown in FIG. 2. The siderails 14, 16 form inwardly facing channels for receiving the carriage rollers 32.

Figure 3:
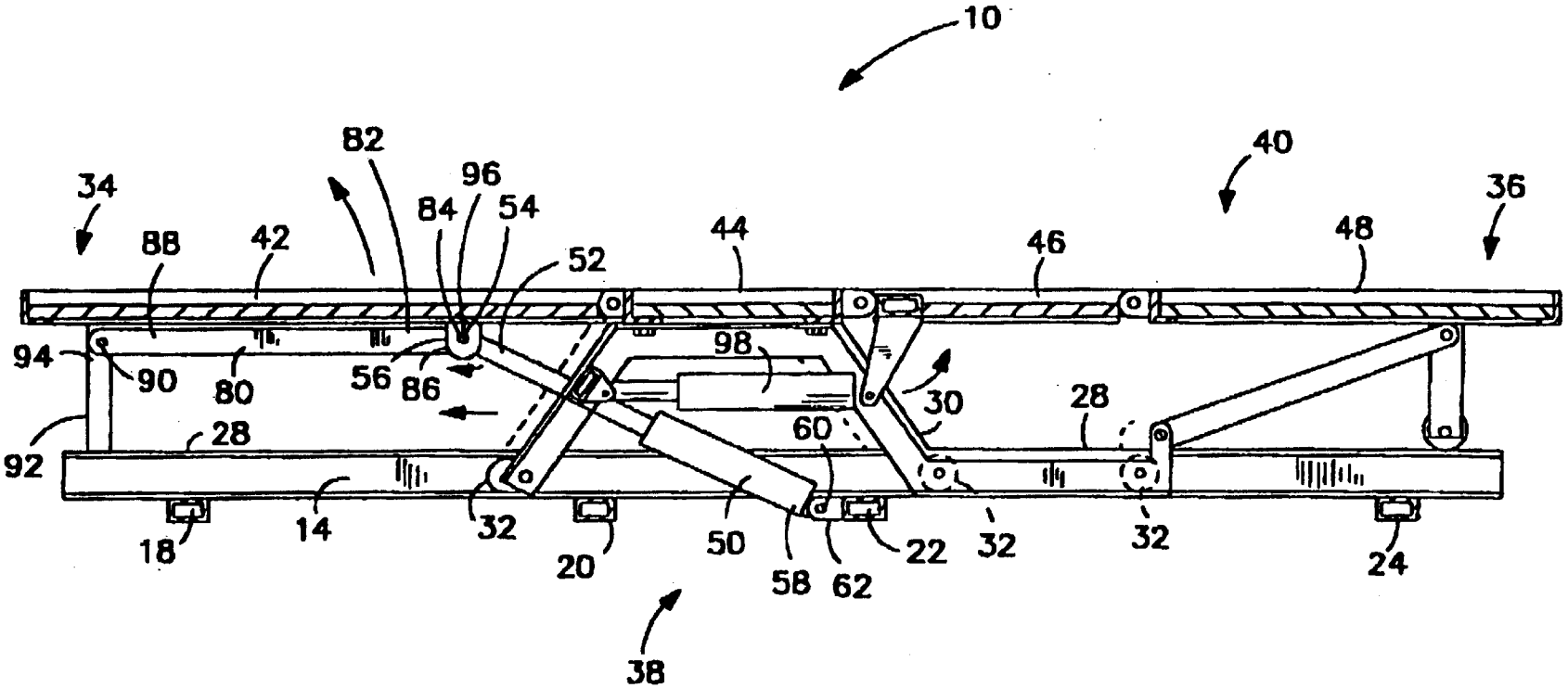
FIG. 3 shows a front sectional view of the bed along line 3—3 in FIG. 2, with the upper frame disposed in a horizontal position.
Figure 4:
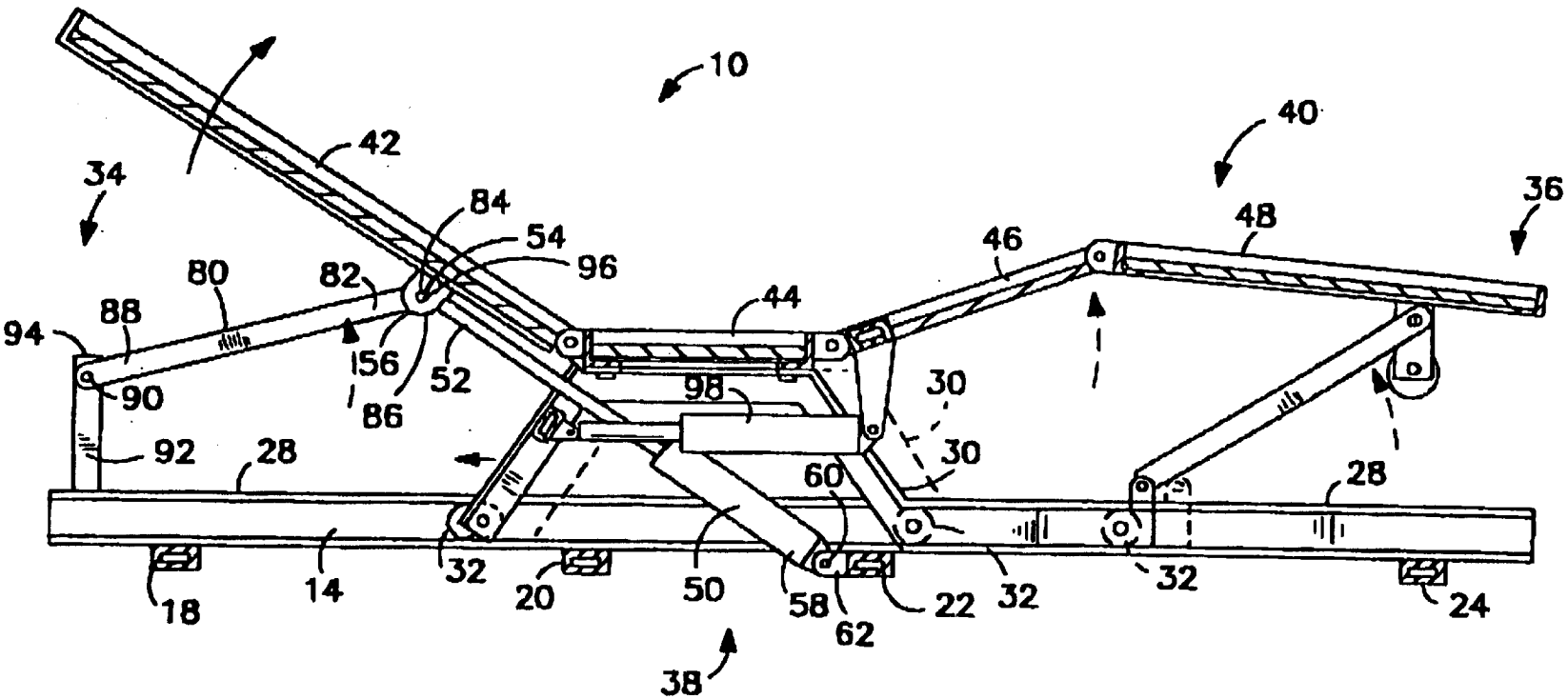
FIG. 4 is a sectional view of the bed similar to FIG. 3, with the upper body, thigh and leg sections articulated.

An upper frame 40 comprises upper body, seat, thigh and leg sections 42, 44, 46 and 48. The seat section 44 is fixed to the carriage 30 for translation therewith. The upper body section 42 and the thigh section 46 pivot upwardly from the seat section 44. The upper body section 42 is movable between a generally horizontal rest position shown in FIG. 3 when the upper frame 40 moves toward a foot end 36 of the bed 10, and an upward raised position shown in FIG. 4 when the upper frame 40 moves toward a head end 34 of the bed 10. The leg section 48 pivots downwardly as shown in FIG. 4 when the thigh section 46 pivots upwardly from the seat section 44.

The upper body, seat, thigh and leg sections 42, 44, 46, 48 are fabricated from upwardly and inwardly opening channels and are hinged together in a conventional manner. Pop-out panels are received in the channels of the respective frame sections 42, 44, 46, 48. The pop-out panels may be made from any type of rigid lightweight panel material, such as plywood, chip board or OSB board. The panels may be covered with decorative material or coated to have a pleasing appearance. Each panel drops into a respective frame section 42, 44, 46, 48 to be held in place by the weight of the panel and a mattress (not shown) placed on the upper frame 40. Illustratively, the base frame 12, the carriage 30, and the upper frame 40 are made from suitable high strength, lightweight rigid materials, such as aluminum, high strength plastic or a composite.

An articulating mechanism 38 of the present invention includes a drive assembly 50 for translating the upper body section 42 such that when the upper body section 42 moves toward the head end 34 of the bed 10 the upper body section 42 is tilted toward the upward raised position, and such that when the upper body section 42 moves toward the foot end 36 of the bed 10 the upper body section 42 is tilted toward the generally horizontal rest position. The drive assembly 50 has a first end 52 pivotally secured at a pivot point 54 to a bracket 56 mounted on the underside of the upper body section 42 intermediate of the longitudinal ends thereof. A second end 58 of the drive assembly 50 is pivotally secured at a pivot point 60 to a bracket 62 mounted on a transversely extending strut member 22. The lateral ends of the transversely extending strut member 22 are fixed to the siderails 14 and 16. The articulating mechanism 38 further includes a pair of links 80, one on each side of the bed 10. First ends 82 of the links 80 are pivotally secured at pivot points 84 to respective brackets 86 mounted on the underside of the upper body section 42 intermediate of the longitudinal ends thereof. Second ends 88 of the links 80 adjacent to the head end 34 of the base frame 12 are pivotally secured at pivot points 90 to the top ends 94 of respective support posts 92 mounted on the siderails 14 and 16 adjacent to the head end 34 of the bed 10. The top ends 94 of the support posts 92 support the upper body section 42 in the generally horizontal rest position shown in FIG. 3. The pivot point 54 at which the drive assembly 50 is pivotally connected to the upper body section 42 and the pivot points 84 at which the links 80 are pivotally connected to the upper body section 42 are substantially disposed along a common pivot axis 96 substantially perpendicular to the longitudinal axis 26 of the articulating bed 10.

It will be noted that the links 80 are pivotally secured to the top ends 94 of the support posts 92 at pivot points 90 disposed substantially above the siderails 14 and 16, instead of at points directly on or adjacent to the siderails 14 and 16. In one configuration, the pivot points 84 at which the links 80 are pivotally secured to the underside of the upper body section 42 and the pivot points 90 at which the links 80 are pivotally secured to the support posts 92 are disposed in a substantially horizontal plane when the upper frame 40 is in the generally horizontal rest position as shown in FIG. 3. In contrast, the pivot point 54 at which the drive assembly 50 is pivotally secured to the upper body section 42 is arranged substantially above the pivot point 60 at which the drive assembly 50 is pivotally secured to the base frame 12 when the upper frame 40 is in the generally horizontal rest position shown in FIG. 3.

In operation, when the upper frame 40 is in the generally horizontal rest position or otherwise away from the upward raised position, the drive assembly 50 may be operated to translate the upper body section 42 and the rest of the upper frame 40 and the carriage 30 toward the head end 34 of the bed 10. As the upper body section 42 moves toward the head end 34 of the bed 10, the links 80 pivotally connected between the upper body section 42 and the base frame 12 cause the upper body section 42 to tilt upwardly toward the upward raised position shown in FIG. 4. On the other hand, when the upper frame 40 is in the upward raised position or otherwise away from the generally horizontal rest position, the drive assembly 50 may translate the upper body section 42 toward the foot end 36 of the bed 10. As the upper body section 42 moves toward the foot end 36 of the bed 10, the links 80 cause the upper body section 42 to tilt downwardly toward the generally horizontal rest position shown in FIG. 3. The upper body section 42 rests on the top ends 94 of the support posts 92 when the upper body section 42 is fully lowered to the generally horizontal rest position.

Thus, as shown in FIG. 3, the pivot point 54 at which the drive assembly 50 is pivotally secured to the underside of the upper body section 42 and the pivot points 84 at which the links 80 are pivotally secured to the underside of the upper body section 42 are substantially horizontally and vertically aligned along the common pivot axis 96 perpendicular to the longitudinal axis 26 of the bed 10. It will be clear, however, to the persons skilled in the art that the pivot axis of the pivot point 54 may be spaced apart from the pivot axis of pivot points 84 within a narrow range without exceeding the scope of the invention. The pivot points 90 at which the links 80 are pivotally secured to the support posts 92 and the pivot points 84 at which the links 80 are pivotally secured to the underside of the upper body section 42 are disposed substantially in a horizontal plane when the upper frame 40 is in the generally horizontal rest position. Again it will be clear, however, to those skilled in the art that the pivot axis of the pivot points 90 may be vertically spaced apart from the pivot axis of the pivot points 84 within a narrow range without exceeding the scope of the invention—for example, as explained below in conjunction with FIG. 5. The pivot point 54 at which the drive assembly 50 is pivotally secured to the underside of the upper body section 42, on the other hand, is arranged substantially above the pivot point 60 at which the drive assembly 50 is pivotally secured to the base frame 12 when the upper frame 40 is in the generally horizontal rest position.

Figure 5:
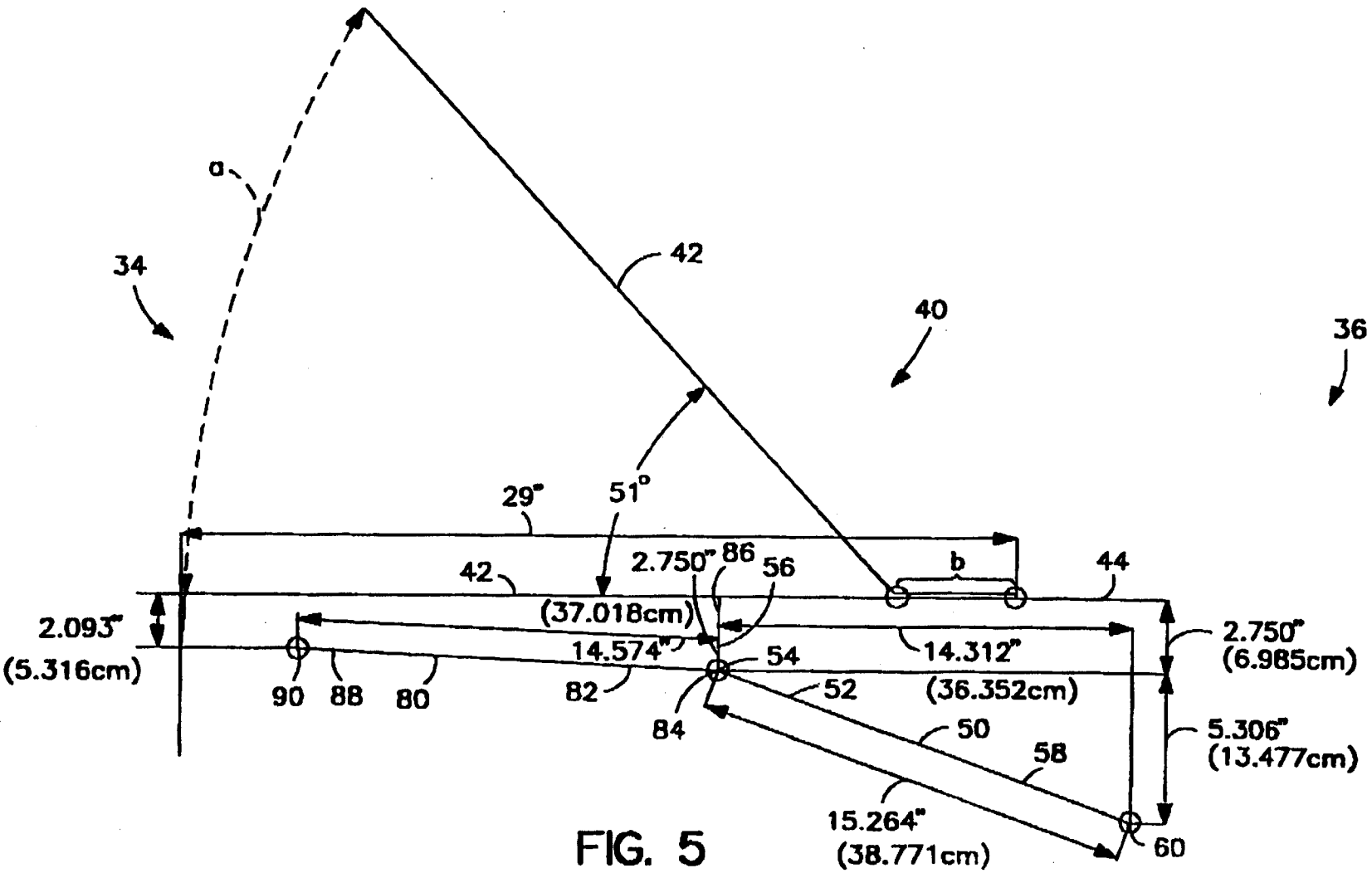
FIG. 5 is a schematic representation showing an alternative configuration of the pivot points of the articulating mechanism of the present invention.

Although the pivot points 84 at which the links 80 are pivotally secured to the underside of the upper body section 42 and the pivot points 90 at which the links 80 are pivotally secured to the base frame 12 are disposed substantially in a horizontal plane in the configuration shown and described in FIGS. 1–4, the pivot points 90 at which the links 80 are pivotally secured to the base frame 12, however, may alternatively be disposed slightly above the pivot points 84 at which the links 80 are pivotally secured to the underside of the upper body section 42, as schematically shown in FIG. 5, to achieve a preferred trajectory "a" of the upper body section 42 when the upper body section 42 is articulated. Translation of a pivot axis connecting the upper body section 42 to the seat section 44 during translation of the carriage 30 is shown as "b" in FIG. 5.

Electrical user controls (not shown) for drive assembly 50 may be located adjacent to the seat section 44. Alternatively, a wired or wireless remote control may be provided for operating the drive assembly 50. A person lying in the bed 10 may manipulate the electrical user controls to reconfigure the bed 10 to a more comfortable position. A suitable electrical motor for use as the drive assembly 50 is a linear actuator motor sold by Linak Company of Denmark as Model LA 31.1.

The articulating bed 10 includes a second drive assembly 98 for lifting and lowering the thigh and leg sections 46 and 48 as shown in FIGS. 3 and 4. The construction and operation of the second drive assembly 110 is described in detail in the afore-mentioned, commonly assigned U.S. patent application, Ser. No. 09/064,292, filed on Apr. 22, 1998, now U.S. Pat. No. 6,006,379, the specification of which is herein incorporated by reference.

Figure 6:
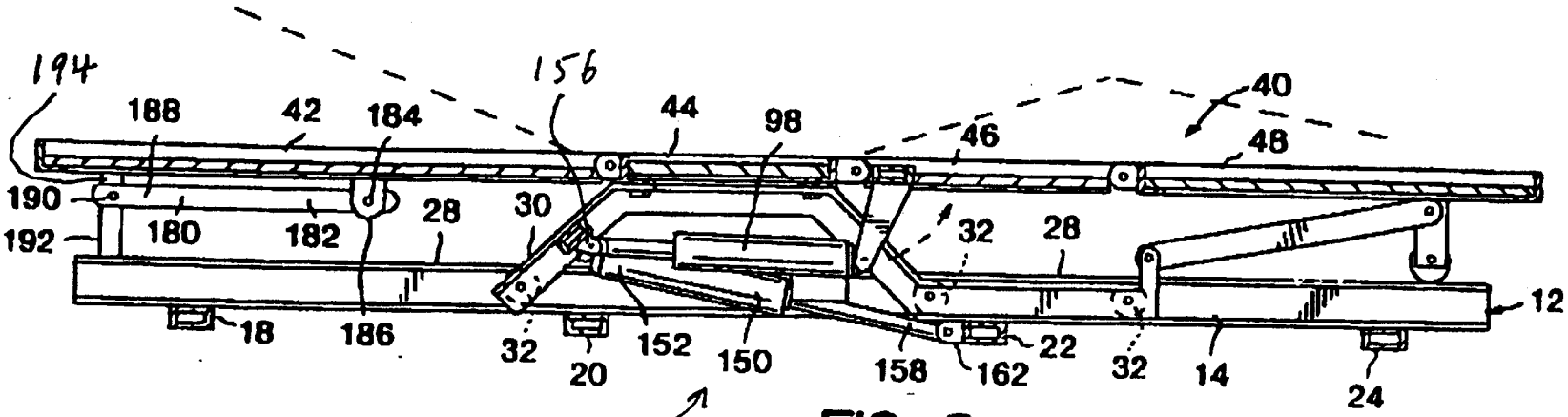
FIGS. 6 and 7 are views similar to FIGS. 3 and 4 showing another embodiment of the articulating mechanism of the present invention.
Figure 7:
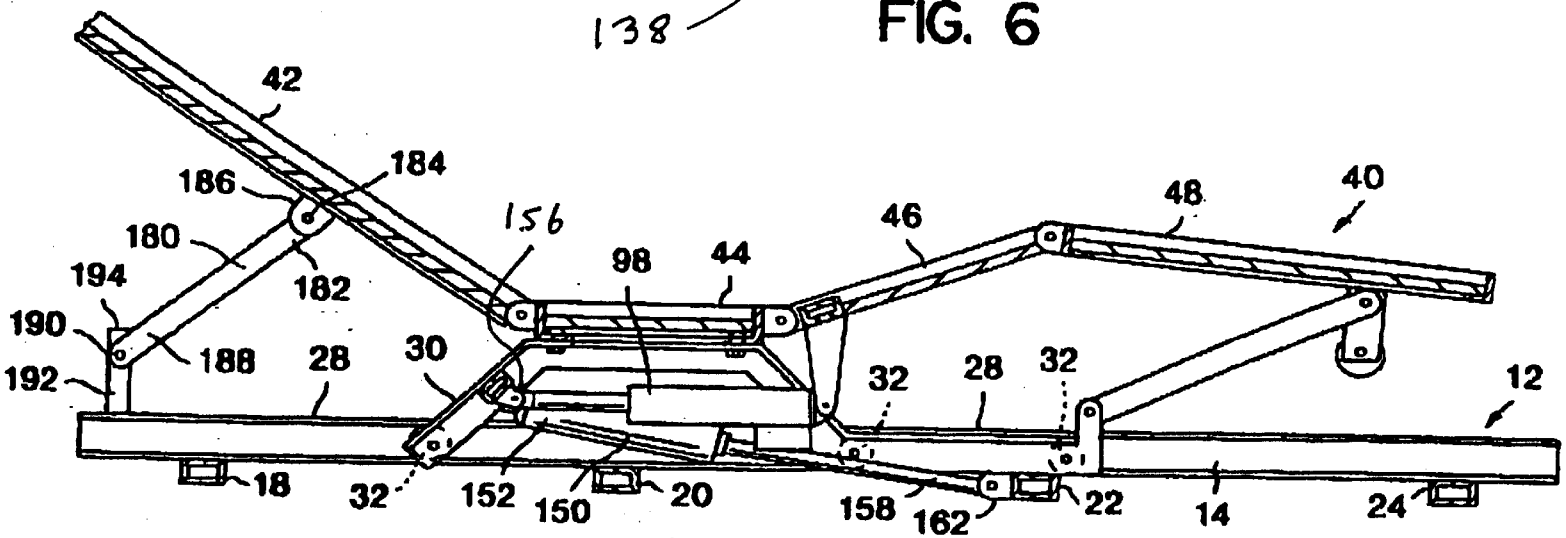

FIGS. 6 and 7 show another embodiment of the articulating mechanism 38 of the present invention, identified by numeral 138 in FIGS. 6 and 7. Corresponding parts shared by the two embodiments are identified in the description below using like reference numbers. The mechanism 138 includes a drive assembly 150 operatively coupled between the carriage 30 and the base frame 12 to translate the carriage 30 relative to the base frame 12, and a pair of links 180 having first ends 182 pivotally coupled to the upper body section 42 at pivot points 184 to brackets 186 and second ends 188 pivotally coupled to the base frame 12 at pivot points 190 adjacent to the top ends 194 of support posts 192. The drive assembly 150 has a first end 152 pivotally secured to a bracket 156 coupled to the carriage 30 and a second end 158 pivotally secured to a bracket 162 coupled to the strut member 22. It will be noted that the links 180 are pivotally secured to the top ends 194 of the support posts 192 at pivot points 190 disposed substantially above the top surface 28 of the base frame 12, instead of at points directly on or adjacent to the siderails 14 and 16.

In operation, when the upper frame 40 is in the generally horizontal rest position or otherwise away from the upward raised position, the drive assembly 150 may be operated to translate the carriage 30 toward the head end 34 of the bed 10. As the carriage 30 moves toward the head end 34 of the bed 10, the links 180 pivotally connected between the upper body section 42 and the top ends 194 of the support posts 192 cause the upper body section 42 to tilt upwardly toward the upward raised position. On the other hand, when the upper frame 40 is in the upward raised position or otherwise away from the generally horizontal rest position, the drive assembly 50 may translate the carriage 30 toward the foot end 36 of the bed 10 to lower the upper body section 42 toward the generally horizontal rest position. The upper body section 42 rests on the top ends 194 of the support posts 192 when the upper body section 42 is fully lowered to the generally horizontal rest position.

Although the invention has been described in detail with reference to certain illustrated embodiments, variations and modifications exist within the scope and spirit of the present invention as described and defined in the following claims.

What is claimed is:

1. A bed frame comprising:

a base frame having a head end, a foot end, and opposite longitudinally extending sides, a carriage mounted on the base frame for longitudinal shifting of the carriage relative to the base frame along a longitudinal axis, an articulating upper frame mounted on the carriage for longitudinal shifting therewith and comprising at least an upper body section and a seat section, the upper body and seat sections being longitudinally spaced apart and transversely extending with the upper body section tiltable relative to the seat section, a drive pivotally connected at a first end to the upper body section and pivotally connected at a second end to the base frame for tilting the upper body section relative to the base frame, a link pivotally connected at a first end to the upper body section and pivotally connected at a second end to the base frame such that tilting of the upper body section relative to the base frame results in longitudinal shifting of the carriage with respect to the base frame, and wherein a pivot point at which the drive is pivotally connected to the upper body section and a pivot point at which the link is pivotally connected to the upper body section are substantially disposed along a common pivot axis substantially perpendicular to the longitudinal axis.

2. The bed frame of claim 1 in which the link is pivotally connected to the upper body section and the base frame to cause the carriage to shift toward the head end of the bed when the upper body section tilts upwardly toward an upward raised position, and to cause the carriage to shift toward the foot end of the bed when the upper body section tilts downwardly toward a generally horizontal rest position.

3. A bed frame comprising:

a base frame having a head end, a foot end, and opposite longitudinally extending sides, a carriage mounted on the base frame for longitudinal shifting of the carriage relative to the base frame along a longitudinal axis, an articulating upper frame mounted on the carriage for longitudinal shifting therewith and comprising at least an upper body section and a seat section, the upper body and seat sections being longitudinally spaced apart and transversely extending with the upper body section tiltable relative to the seat section, a drive pivotally connected at a first end to the upper body section and pivotally connected at a second end to the base frame for tilting the upper body section relative to the base frame, a support bracket coupled to the underside of the upper body section, a support post coupled to base frame adjacent to the head end, and a link pivotally connected at a first end thereof to the support bracket and pivotally connected at a second end thereof to the support post such that the carriage shifts toward the head end of the base frame when the upper body section tilts upwardly toward an upward raised position and the carriage shifts toward the foot end of the base frame when the upper body section tilts downwardly toward a generally horizontal rest position, wherein a pivot point at which the drive is pivotally connected to the upper body section and a pivot point at which the link is pivotally connected to the support bracket are substantially disposed along a common pivot axis substantially perpendicular to the longitudinal axis, and wherein the link is pivotally connected to the support post at the second end thereof about a pivot point disposed on a further pivot axis.

4. The bed of claim 3, wherein a top end of the support post supports the upper body section in the generally horizontal rest position, and wherein the second end of the link is pivotally connected to the support post at a location adjacent to the top end of the support post above the base frame.

5. The bed frame of claim 4, wherein the pivot point at which the link is pivotally connected to the upper body section and the pivot point at which the link is pivotally connected to the support post are disposed in a substantially horizontal plane parallel to the longitudinal axis when the upper body section is in the generally horizontal rest position.

6. The bed frame of claim 5 further comprising a further support bracket coupled to the underside of the upper body section and a transverse strut member coupled to the base frame, wherein the drive is pivotally connected at the first end thereof to the further support bracket and pivotally connected at the second end thereof to the transverse strut member, wherein the pivot point at which the drive is pivotally connected to the further support bracket is disposed substantially above the pivot point at which the drive is pivotally connected to the transverse strut member when the upper body section is in the generally horizontal rest position.

7. A bed frame comprising:

a base frame having a head end, a foot end, and opposite longitudinally extending sides, a carriage mounted on the base frame for longitudinal shifting of the carriage relative to the base frame along a longitudinal axis, an articulating upper frame mounted on the carriage for longitudinal shifting therewith and comprising at least an upper body section and a seat section, the upper body and seat sections being longitudinally spaced apart and transversely extending with the upper body section tiltable relative to the seat section, a drive pivotally connected at a first end to the upper body section about a first pivot axis substantially perpendicular to the longitudinal axis and pivotally connected at a second end to the base frame about a second pivot axis parallel to the first pivot axis for tilting the upper body section relative to the base frame, and a link pivotally connected at a first end to the upper body section about the first pivot axis and pivotally connected at a second end to the base frame about a third pivot axis parallel to the first pivot axis such that tilting of the upper body section relative to the base frame results in longitudinal shifting of the carriage with respect to the base frame.

8. The bed frame of claim 7 in which the link is pivotally connected to the upper body section and the base frame such that the carriage shifts toward the head end of the bed when the upper body section tilts upwardly toward an upward raised position and the carriage shifts toward the foot end of the bed when the upper body section tilts downwardly toward a generally horizontal rest position.

9. A bed frame comprising:

a base frame having a head end, a foot end, and opposite longitudinally extending sides, a carriage mounted on the base frame for longitudinal shifting of the carriage relative to the base frame along a longitudinal axis, an articulating upper frame mounted on the carriage for longitudinal shifting therewith and comprising at least an upper body section and a seat section, the upper body and seat sections being longitudinally spaced apart and transversely extending with the upper body section tiltable relative to the seat section, a drive pivotally connected at a first end to the upper body section about a first pivot axis substantially perpendicular to the longitudinal axis and pivotally connected at a second end to the base frame about a second pivot axis parallel to the first pivot axis for tilting the upper body section relative to the base frame, a support bracket coupled to the underside of the upper body section, a support post coupled to the base frame adjacent to the head end, and a link pivotally connected at a first end to the support bracket about a pivot point disposed on the first pivot axis and pivotally connected at a second end to the support post about a pivot point disposed on a third pivot axis parallel to the first pivot axis such that the carriage shifts toward the head end of the base frame when the upper body section tilts upwardly toward an upward raised position and the carriage shifts toward the foot end of the base frame when the upper body section tilts downwardly toward a generally horizontal rest position.

10. The bed of claim 9, wherein a top end of the support post supports the upper body section in the generally horizontal rest position, and wherein the second end of the link is pivotally connected to the support post at a location adjacent to the top end of the support post above the base frame.

11. The bed frame of claim 10, wherein the pivot point at which the link is pivotally connected to the upper body section and the pivot point at which the link is pivotally connected to the support post are disposed in a substantially horizontal plane parallel to the longitudinal axis when the upper body section is in the generally horizontal rest position.

12. The bed frame of claim 11 further comprising a further support bracket coupled to the underside of the upper body section and a transverse strut member coupled to the base frame, wherein the drive is pivotally connected at the first end thereof to the further support bracket and pivotally connected at the second end thereof to the strut member, wherein the first pivot axis about which the drive is pivotally connected to the further support bracket is disposed substantially above the second pivot axis about which the drive is pivotally connected to the transverse strut member when the upper body section is in the generally horizontal rest position.

13.A bed frame comprising:

a base frame having a top surface, a head end, a foot end, and longitudinally-extending siderails held in laterally spaced apart relation by cross members, a support post coupled to the base frame adjacent to the head end, a carnage mounted to the base frame for movement relative thereto between the head end of the base frame and the foot end of the base frame, an articulating upper frame mounted to the carriage for movement therewith relative to the base frame, the upper frame including a seat section and an upper body section movable relative to the seat section, a drive operatively coupled between the carriage and the base frame configured to move the carriage relative to the base frame, and a link having a first end pivotally coupled to the upper body section and a second end pivotally coupled to the support post about a pivot point above the top surface of the base frame so that during movement of the carriage relative to the base frame the link causes movement of the upper body section relative to the seat section.

14. The bed frame of claim 13, wherein a top end of the support post supports the upper body section in the generally horizontal rest position, and wherein the second end of the link is pivotally connected to the support post at a location adjacent to the top end of the support post.

15. The bed frame of claim 14, wherein the first end at which the link is pivotally connected to the upper body section and the second end at which the link is pivotally connected to the support post are disposed in a substantially horizontal plane parallel to the longitudinal axis when the upper body section is in the generally horizontal rest position.

16. A bed frame comprising:

a base frame having a head end, a foot end, and opposite longitudinally extending sides, a support member coupled to the base frame adjacent to the head end, a carriage mounted on the base frame for longitudinal shifting of the carriage relative to the base frame along a longitudinal axis, an articulating upper frame mounted on the carriage for longitudinal shifting therewith and comprising at least an upper body section and a seat section, the upper body and seat sections being longitudinally spaced apart and transversely extending with the upper body section tiltable relative to the seat section, a drive pivotally connected at a first end to the upper body section about a first pivot axis substantially perpendicular to the longitudinal axis and pivotally connected at a second end to the base frame about a second pivot axis parallel to the first pivot axis for tilting the upper body section relative to the base frame, and a link having a first end pivotally coupled to the upper body section about a pivot point disposed on the first pivot axis and a second end pivotally coupled to the support member about a pivot point located above the base frame such that the carriage shifts toward the head end of the base frame when the upper body section tilts upwardly and the carriage shifts toward the foot end of the base frame when the upper body section tilts downwardly.

* * * * *

UNITED STATES PATENT AND TRADEMARK OFFICE

CERTIFICATE OF CORRECTION

PATENT NO. : 6,393,641 B1
DATED : May 28, 2002
INVENTOR(S) : Huibert Paul Pollman et al.

It is certified that error appears in the above-identified patent and that said Letters Patent is hereby corrected as shown below:

Column 5,
Line 26, delete “oe” and insert -- be --
Line 56, delete “$dm^3$” and insert -- $cm^3$ --

Column 10,
Line 21, delete “whcich” and insert -- which --

Signed and Sealed this

Sixteenth Day of March, 2004

JON W. DUDAS
*Acting Director of the United States Patent and Trademark Office*